US006626308B2

(12) United States Patent
Weiler

(10) Patent No.: US 6,626,308 B2
(45) Date of Patent: Sep. 30, 2003

(54) HERMETICALLY SEALED CONTAINER WITH SELF-DRAINING CLOSURE

(75) Inventor: Gerhard H. Weiler, Woodstock, IL (US)

(73) Assignee: Weiler Engineering, Inc., Elgin, IL (US)

( * ) Notice: Subject to any disclaimer, the term of this patent is extended or adjusted under 35 U.S.C. 154(b) by 239 days.

(21) Appl. No.: 09/770,332

(22) Filed: Jan. 26, 2001

(65) Prior Publication Data

US 2002/0100741 A1 Aug. 1, 2002

(51) Int. Cl.[7] ..... B65D 1/02; B65D 41/32
(52) U.S. Cl. ..... 215/48; 215/41; 222/541.6
(58) Field of Search ..... 215/48, 49, 41, 215/228; 222/109, 111, 541.6, 541.9

(56) References Cited

U.S. PATENT DOCUMENTS 2,342,372 A * 2/1944 Scherer ..... 215/48 X
2,811,283 A * 10/1957 Bowen ..... 222/109
3,977,553 A * 8/1976 Cornett, III et al. ..... 215/49
4,349,056 A * 9/1982 Heino ..... 215/228 X
4,458,818 A * 7/1984 Hansen ..... 215/47
4,478,342 A * 10/1984 Slater et al. ..... 215/48
4,821,897 A * 4/1989 Weiler ..... 215/251 X
5,553,732 A * 9/1996 Kani ..... 215/228 X
5,897,009 A * 4/1999 O'Meara ..... 215/48
5,901,865 A 5/1999 Weiler et al. ..... 215/48
5,908,124 A * 6/1999 Klauke et al. ..... 215/48
5,944,206 A * 8/1999 Culter et al. ..... 215/48
6,068,148 A 5/2000 Weiler ..... 215/48

* cited by examiner

*Primary Examiner*—Sue A. Weaver
(74) *Attorney, Agent, or Firm*—Olson & Hierl, Ltd.

(57) ABSTRACT

A hermetically sealed container including a dispensing nozzle and a hollow closure with a lobate region removably secured thereto along a frangible web. The lobate region in the hollow closure reduces the retention of liquid droplets against the closure inner surface. The nozzle includes a straight inwardly and upwardly tapered wall which causes liquid droplets or aliquots in the closure and the nozzle to pass downwardly into the body of the container. As a result, liquid is not splashed when the closure is severed from the nozzle along the frangible web.

15 Claims, 3 Drawing Sheets

HERMETICALLY SEALED CONTAINER WITH SELF-DRAINING CLOSURE

FIELD OF THE INVENTION

This invention relates to a hermetically sealed container and, more particularly, to a hermetically sealed container incorporating an improved closure and dispensing nozzle which reduce splashing of the container contents when the closure is severed from the dispensing nozzle.

BACKGROUND OF THE INVENTION

Various types of hermetically sealed containers have been used and are known for dispensing liquid medicaments or the like. One such prior art container embodiment is shown in FIGS. 1 and 2 attached which includes a body portion adapted to contain a liquid solution, a dispensing nozzle terminating in an aperture, and a removable closure portion unitary with the dispensing nozzle and delineated therefrom by a frangible web that circumscribes the aperture of the dispensing nozzle and is severable from the dispensing nozzle at the frangible web.

Although the prior art container shown in FIGS. 1 and 2 attached has proven quite useful, one disadvantage associated with the structure of the closure portion and dispensing nozzle thereof is that droplets of the liquid or solution in the container sometimes have a tendency to build up and adhere against the inner surfaces of both the removable closure and the dispensing nozzle as shown in FIG. 2. This, in turn, causes liquid droplets to be splashed outside the container when the removable closure is severed from the dispensing nozzle along the frangible web, or retained in the removable closure.

It would thus be desirable to provide a container with a removable closure and dispensing nozzle structured to facilitate the drainage of any liquid droplets disposed against the inner surface of either the removable closure or the dispensing nozzle back into the body of the container. This, in turn, would minimize the risk of any splashing of liquid droplets when the removable closure is snapped off to gain access to the container contents. The present invention provides a container with such an improved removable closure and dispensing nozzle.

SUMMARY OF THE INVENTION

The hermetically sealed container of the present invention includes a body which is adapted to contain a liquid and terminates in a unitary throat, a dispensing nozzle which is unitary with the throat and terminates in an aperture, and a removable closure unitary with the dispensing nozzle and delineated therefrom by a frangible web that circumscribes the aperture of the dispensing nozzle. The closure is severable from the dispensing nozzle at the frangible web.

In accordance with the present invention, the removable closure is hollow and includes a top portion having a downwardly depending lobate region therein, and the dispensing nozzle includes an inwardly and upwardly tapered straight wall adapted to cause any droplets of liquid in the removable closure and the dispensing nozzle to flow downwardly into the body. As a result, substantially no liquid is splashed or retained in the removable closure when the closure is snapped off of the nozzle along the frangible web.

In one embodiment of the present invention, the lobate region in the closure is a cone-shaped projection defined by a circumferentially inwardly extending tapered surface terminating in a point. The circumferentially inwardly extending surface is tapered at about a 45 degree angle relative to the container vertical axis, and the projection occupies at least about one-third of the interior volume of the removable closure. Additionally, the wall of the dispensing nozzle tapers inwardly and upwardly at an acute angle, usually about a 18 to 20 degree angle relative to the longitudinal axis of the container.

In another embodiment of the present invention, the lobate region is a ball-shaped projection in the top portion of the removable closure which also occupies at least about one-third of the interior volume of the removable closure.

Numerous other advantages and features of the present invention will become readily apparent from the following detailed description of the invention, the claims, and the accompanying drawings.

DESCRIPTION OF THE PREFERRED EMBODIMENTS

Figure 2:
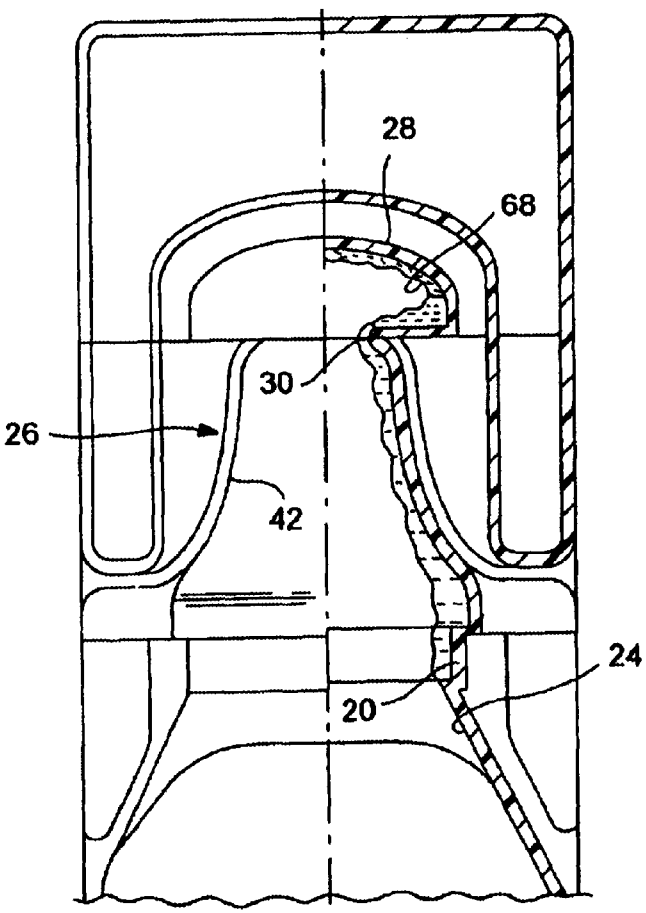
FIG. 2 PRIOR ART
FIG. 2 is an enlarged fragmentary part cross-sectional view in elevation of the dispensing nozzle and removable closure of the prior art hermetically sealed container of FIG. 1.
Figure 1:
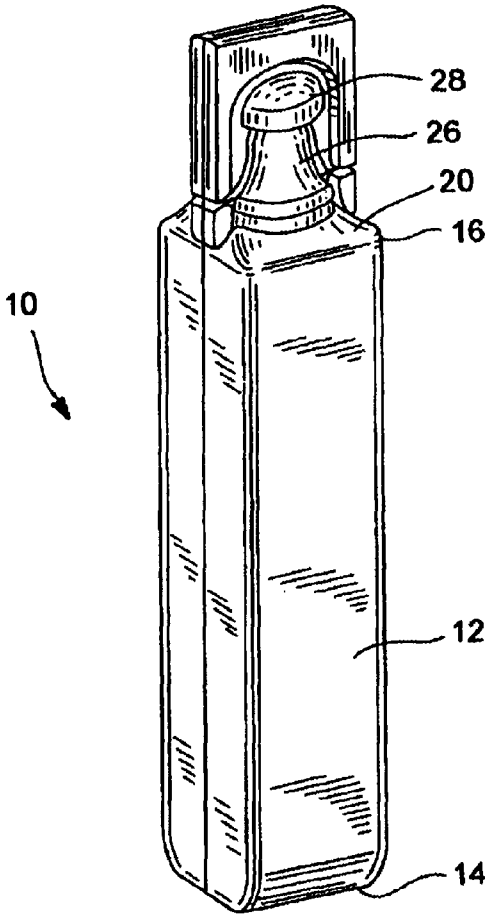
FIG. 1 PRIOR ART
FIG. 1 is a perspective view of a prior art hermetically sealed container.

A formed, filled, and hermetically sealed container 10 in accordance with the prior art is illustrated in FIGS. 1–2. The container 10 is preferably fabricated or produced by the so-called blow-fill-seal techniques such as, for example, the blow/fill/seal techniques shown in and described in U.S. Pat. No. 4,671,763 to Weiler from conventional thermoplastic materials such as polyethylene (low or high density), polypropylene, and the like materials compatible with the container contents.

Container 10 includes a hollow body portion 12 having a bottom surface 14 and a top 16 that terminates in a throat 20 defining a hollow passageway 24 in fluid flow communication with the liquid container contents.

The throat 20, in turn, terminates in a dispensing nozzle 26 and a closure portion 28 that seals the dispensing nozzle 26. Dispensing nozzle 26 and closure portion 28 are unitary with one another, but closure portion 28 is removable from the dispensing nozzle 26 upon the fracture or severance of a frangible web 30 that sealingly but removably connects the closure portion 28 to the dispensing nozzle 26.

Dispensing nozzle 26 includes a circumferentially extending bell-shaped wall 42 which tapers upwardly and inwardly from the throat 20. Closure portion 28 is generally dome-shaped and defines an inner dome-shaped closure cavity 68. As shown in FIG. 2, droplets of the liquid container contents have a tendency to build up on and adhere to the inner surfaces of both the closure portion 28 and the nozzle 26. As a result, droplets of liquid are sometimes splashed outside the container 10 or retained within the closure 28 when the closure 28 is snapped off the nozzle 26 along the frangible web 30.

The present invention, shown in FIGS. 3–6, minimizes the splashing and liquid retention drawbacks associated with the prior art container of FIG. 2. The invention disclosed herein is, of course, susceptible of embodiment in many different forms. Shown in FIGS. 3–6 and described below in detail are two embodiments of the container of the present invention. It is to be understood, however, that the present disclosure is an exemplification of the principles of the invention and does not limit the invention to the illustrated preferred embodiments.

The precise shapes and sizes of the container described herein are not essential to the invention unless otherwise indicated.

For ease of description, the container of the present invention will be described in a normal (upright) operating position and terms such as upper, lower, horizontal, etc., will be used with reference to this position. It will be understood, however, that the container of the present invention may be manufactured, stored, transformed, used, and sold in an orientation other than the position shown and described herein.

Figure 4:
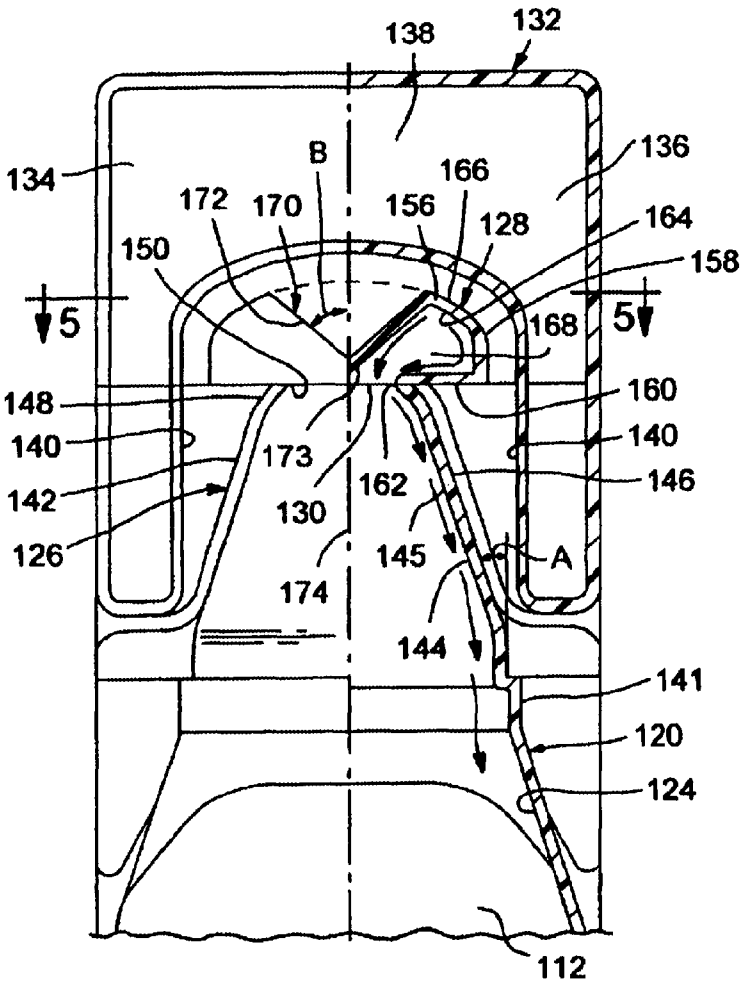
FIG. 4 is an enlarged fragmentary part cross-sectional view in elevation of the hermetically sealed container of the present invention.
Figure 3:
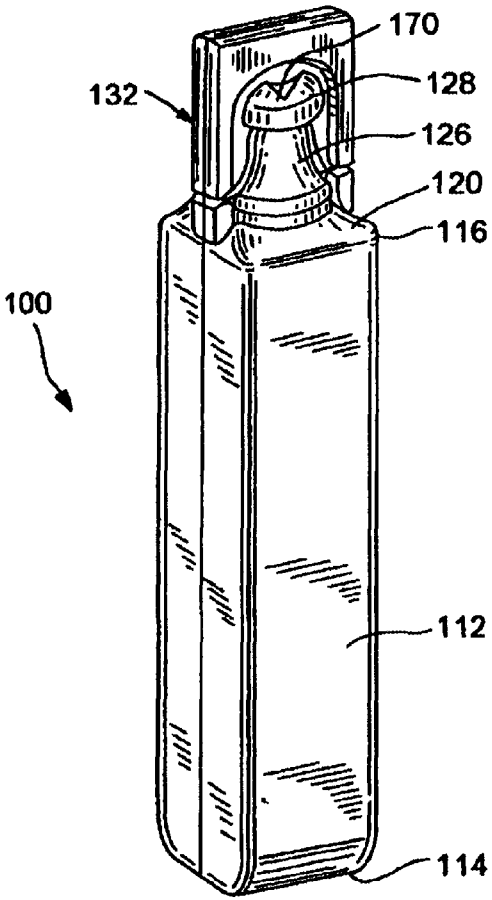
FIG. 3 is a perspective view of a hermetically sealed container in accordance with the present invention.
Figure 5:
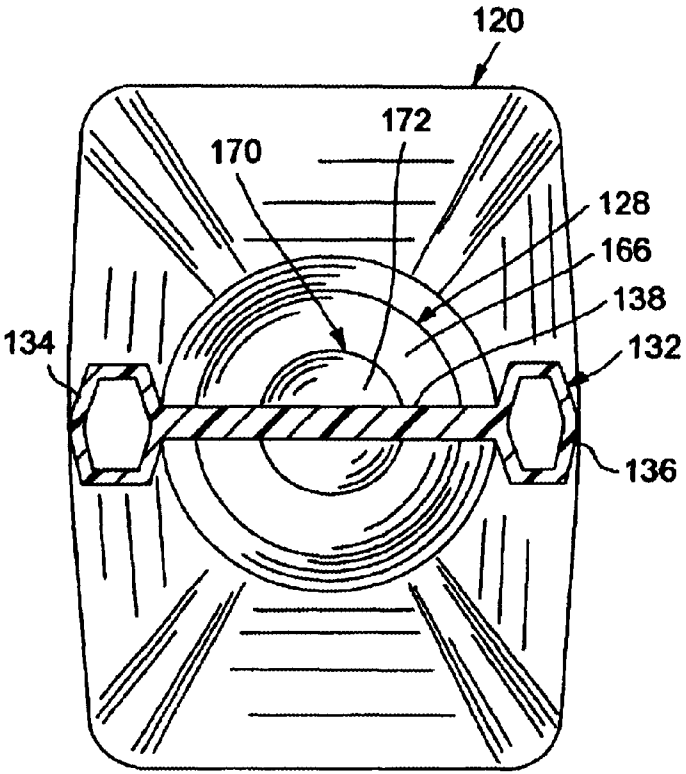
FIG. 5 is an enlarged plan view of the hermetically sealed container of the present invention taken along the lines 5—5 in FIG. 4.

A formed, filled, and hermetically sealed container 100 in accordance with one embodiment of the present invention is illustrated in FIGS. 3–5. The container 100 is preferably fabricated or produced by the so-called blow-fill-seal techniques such as, for example, the blow/fill/seal techniques shown in and described in U.S. Pat. No. 4,671,763 to Weiler from conventional thermoplastic materials such as polyethylene (low or high density), polypropylene, and the like materials compatible with the container contents.

The teachings of the present invention find application in the production of filled containers having a wide variety of shapes and sizes. Container 100 is an example of one such container and includes a hollow body portion 112 having a bottom surface 114 and a top 116 that terminates in a throat 120 defining a hollow passageway 124 in fluid flow communication with the liquid container contents.

The throat 120, in turn, terminates in a dispensing nozzle 126 and has a hollow closure portion 128 that seals the dispensing nozzle 126 and includes a lobate region 170, i.e., a rounded and inwardly projecting region. Dispensing nozzle 126 and closure portion 128 are unitary with one another. Closure portion 128 is removable from the dispensing nozzle 126, however, upon the fracture or severance of a frangible web 130 that sealingly but removably connects the closure portion 128 to the dispensing nozzle 126. The lobate region 170 of the hollow closure portion 128 will be described in greater detail hereinbelow.

A grip tab 132 in the shape of an inverted "U" surrounds the closure portion 128. Tab 132 includes two spaced-apart wings 134 and 136, and a bridge 138 therebetween. Bridge 138 is unitary with and extends generally longitudinally above the top of the closure portion 128. Wings 134 and 136 are unitary with opposite ends of the bridge 138 and extend generally vertically downwardly therefrom. Each of the wings 134 and 136 also includes an inner surface 140 spaced from and positioned generally adjacent and parallel to the dispensing nozzle 126.

Dispensing nozzle 126 includes a generally cylindrically shaped base 141 and a circumferentially extending frustoconical wall 142 which tapers upwardly and inwardly from the base 141 and the throat 120. The wall 142 is straight and includes an inner surface 144 defining an open, axial passageway 145 and an outer surface 146. In accordance with the present invention, the wall 142 tapers inwardly and upwardly at an acute angle, preferably at an angle A of about 18 degrees from the longitudinal axis of the container. This angle can vary, however.

The wall 142 terminates in a top peripheral inwardly tapered circumferentially and radially extending lip 148 which defines a top opening 150 in fluid flow communication with the passageway 145 which, in turn, is in fluid flow communication with the opening 124 defined in the throat 120.

Hollow closure portion 128 is generally dome-shaped and includes a radial dome-shaped top wall 156, a side wall 158 extending generally vertically, circumferentially and unitarily downwardly from the peripheral circumferential edge of the top wall 156, and a bottom wall 160 extending generally horizontally, and unitarily inwardly from the peripheral circumferential lower edge of the side wall 158. The bottom wall 160, in turn, includes an inner circumferentially extending edge 162 which is unitary with and delineated from the lip 148 of the dispensing nozzle 126 by the frangible web 130.

The top wall 156, side wall 158 and bottom wall 160 together define a closure portion 128 including inner and outer closure surfaces 164 and 166 respectively. The inner closure surface 164 defines an inner dome-shaped closure cavity 168.

A downwardly depending lobate region 170 is in the top wall 156. In the embodiment of FIGS. 3–5, the lobate region 170 within the hollow closure portion 128 is in the form of a generally cone-shaped projection which includes a circumferentially and radially inwardly extending frustoconical surface 172 which tapers inwardly from the top wall 156 into the closure cavity 168 and terminates in a point 173 generally aligned with the container vertical axis 174. The lobate region 170 can also be bullet-shaped, ball-shaped, and the like.

The surface 172 of lobate region 170 tapers outwardly from the point 173 thereof at an angle B of about 45 degrees relative to the container vertical axis 174.

Figure 6:
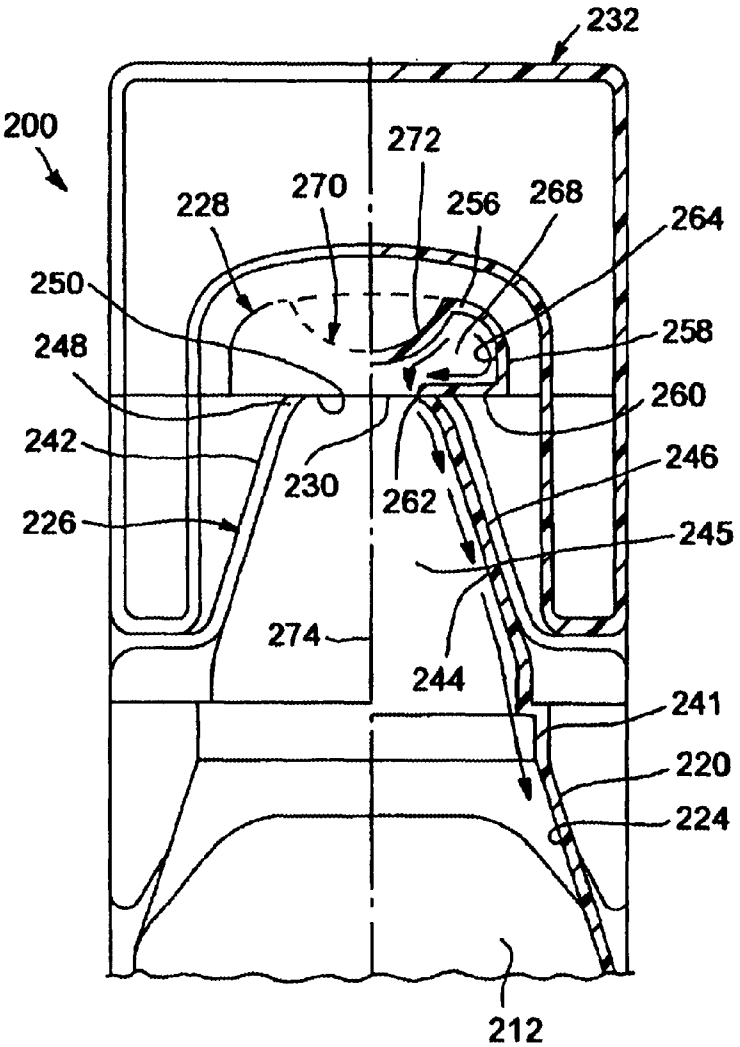
FIG. 6 is an enlarged fragmentary part cross-sectional view in elevation of an alternate embodiment of the hermetically sealed container of the present invention.

In an alternate container embodiment 200 as shown in FIG. 6, the top wall 256 of the closure portion 228 includes a lobate region 270 in the form of a circumferentially and radially extending projection having a rounded surface 272 which extends inwardly from the top wall 256 into the cavity 268 of the hollow closure portion 228. The container embodiment 200 is otherwise similar in structure to the container embodiment 100. In both the container embodiments of FIGS. 4 and 6, and in accordance with the present invention, the respective lobate regions 170 and 270 occupy at least about one-third of the internal volume of the respective hollow closure portions 128 and 228.

As indicated by the arrows in FIGS. 4 and 6 respectively, the lobate regions 170 and 270 in the respective closure portions 128 and 228 in combination with the orientation and structure of the walls 142 and 242 of the respective dispensing nozzles 126 and 226 that define respective passageways 145 and 245 advantageously allow any of the container liquid contents which may be held against the inner surfaces of the respective closure portions 128 and 228 and nozzles 126 and 226 to pass downwardly via throats 120 and 220 into the hollow body portions 112 and 212 of the respective containers 100 and 200. Like wall 142 in FIG. 4, wall 242 in FIG. 4 terminates in an inwardly tapered circumferentially and radially extending lip 248 which defines a top opening 250 in fluid flow communication with the passageway 245.

More particularly, the respective lobate regions 170 and 270 advantageously reduce by at least about one-third the inner volume of the respective closure portions and thus also reduce the surface 128 and 228, from which liquid droplets may be suspended.

The orientation and placement of the respective lobate surfaces 172 and 272 adjacent the respective inner edges 162 and 262 of the respective walls 160 and 260 of the respective closure portions 128 and 228 also advantageously causes any liquid droplets which may form on the inner faces of the respective lobate surfaces 172 and 272 to travel downwardly in the direction of the respective nozzle openings 150 and 250 where the droplets formed on the respective lobate surfaces 172 and 272 are joined with droplets formed along the inner edges 162 and 262 of the respective walls 160 and 260 and then pass downwardly along the respective straight inner surfaces 144 and 244 of the respective nozzle walls 142 and 242 and respective bases 141 and 241 into the respective hollow container body portions 112 and 212.

As opposed to the bell-shaped wall of the nozzle of the prior art container shown in FIG. 2 which inhibits and prevents the smooth downward flow of liquid droplets along the surface thereof, the straight and tapered shape of the walls 142 and 242 of the respective nozzles 126 and 226 provide for the smooth and constant downwardly flow of the liquid droplets into the container body portion.

As a result, the present invention minimizes the likelihood of liquid droplets or liquid aliquots in the area of the respective frangible webs 130 and 230, thus reducing the risk of splashing of the container contents when the respective closure portions 128 and 228 are snapped off the top of the respective nozzles 126 and 226.

The foregoing description and the drawings are intended as illustrative, and are not to be taken as limiting. Still other variations within the spirit and scope of the present invention are possible and will readily present themselves to those skilled in the art.

I claim:

1. A hermetically sealed container comprising:

a body adapted to contain a solution and terminating in a unitary throat;

a dispensing nozzle unitary with the throat and terminating in an aperture, the dispensing nozzle including an inwardly and upwardly tapered straight wall; and a removable hollow closure unitary with the dispensing nozzle and delineated therefrom by a frangible web that circumscribes the aperture of the dispensing nozzle, the closure being severable from the dispensing nozzle at the frangible web, the removable closure including a top portion having a lobate region therein, the inner wall of the dispensing nozzle and the lobate region on the removable closure being adapted to cause any liquid in the removable closure and the dispensing nozzle to flow downwardly into the body.

2. The container of claim 1, wherein the lobate region is a cone-shaped projection in the top portion of the removable closure.

3. The container of claim 2, wherein the cone-shaped projection is defined by a circumferentially inwardly extending tapered surface terminating in a point.

4. A hermetically sealed container comprising:

a body adapted to contain a solution and terminating in a unitary throat;

a dispensing nozzle unitary with the throat and terminating in an aperture, the dispensing nozzle including an inwardly and upwardly tapered straight wall; and a removable hollow closure unitary with the dispensing nozzle and delineated therefrom by a frangible web that circumscribes the aperture of the dispensing nozzle, the closure being severable from the dispensing nozzle at the frangible web, the removable closure including a top portion having a lobate region therein, the inner wall of the dispensing nozzle and the lobate region on the removable closure being adapted to cause any liquid in the removable closure and the dispensing nozzle to flow downwardly into the body, and the lobate region being a cone-shaped projection in the top portion of the removable closure and the cone-shaped projection being defined by a circumferentially inwardly extending tapered surface that terminates in a point and is tapered at about a 45 degree angle relative to the container vertical axis.

5. The container of claim 4, wherein the cone-shaped projection occupies at least about one-third of the interior volume of the hollow removable closure.

6. A hermetically sealed container comprising:

a body adapted to contain a solution and terminating in a unitary throat;

a dispensing nozzle unitary with the throat and terminating in an aperture, the dispensing nozzle including an inwardly and upwardly tapered straight wall; and a removable hollow closure unitary with the dispensing nozzle and delineated therefrom by a frangible web that circumscribes the aperture of the dispensing nozzle, the closure being severable from the dispensing nozzle at the frangible web, the removable closure including a top portion having a lobate region therein, the inner wall of the dispensing nozzle and the lobate region on the removable closure being adapted to cause any liquid in the removable closure and the dispensing nozzle to flow downwardly into the body, and the lobate region being a ball-shaped projection in the top portion of the removable closure.

7. The container of claim 6, wherein the projection occupies at least about one-third of the interior volume of the hollow removable closure.

8. A hermetically sealed container comprising:

a body adapted to contain a solution and terminating in a unitary throat;

a dispensing nozzle unitary with the throat and terminating in an aperture, the dispensing nozzle including an inwardly and upwardly tapered straight wall; and a removable hollow closure unitary with the dispensing nozzle and delineated therefrom by a frangible web that circumscribes the aperture of the dispensing nozzle, the closure being severable from the dispensing nozzle at the frangible web, the removable closure including a top portion having a lobate region therein, the inner wall of the dispensing nozzle and the lobate region on the removable closure being adapted to cause any liquid in the removable closure and the dispensing nozzle to flow downwardly into the body and wherein the throat includes a generally horizontal radial base and the wall of the dispensing nozzle tapers inwardly and upwardly at about an 18 degree angle from the longitudinal axis of the container.

9. In a hermetically sealed container of a thermoplastic material including a body adapted to contain a solution, a dispensing nozzle unitary with the body and terminating in an aperture, and a removable, hollow closure sealing the aperture and including a top, the improvement comprising a lobate region in the top portion of the closure adapted to cause any liquid in the closure to flow downwardly into the dispensing nozzle and into the body of the container.

10. The container of claim 9, wherein said lobate region is a cone-shaped projection in the top portion of the closure.

11. The container of claim 10, wherein said cone-shaped projection is defined by a circumferentially inwardly extending tapered surface terminating in a point.

12. The container of claim 10, wherein said lobate region occupies at least about one-third of the interior volume of the top portion of the closure.

13. The container of claim 9, wherein said lobate region is a ball-shaped projection in the top portion of the closure.

14. In a hermetically sealed container of a thermoplastic material including a body adapted to contain a solution, a dispensing nozzle unitary with the body and terminating in an aperture, and a removable, hollow closure sealing the aperture and including a top, the improvement comprising a lobate region which is a cone-shaped projection in the top portion of the closure adapted to cause any liquid in the closure to flow downwardly into the dispensing nozzle and into the body of the container, and wherein said cone-shaped projection is defined by a circumferentially inwardly extending tapered surface terminating in a point and is disposed at about a 45 degree angle relative to the closure vertical axis.

15. In a hermetically sealed container of a thermoplastic material including a body adapted to contain a solution, a dispensing nozzle unitary with the body and terminating in an aperture, and a removable, hollow closure sealing the aperture and including a top, the improvement comprising a lobate region which is a ball-shaped projection in the top portion of the closure adapted to cause any liquid in the closure to flow downwardly into the dispensing nozzle and into the body of the container and wherein said projection occupies at least about one-third of the interior volume of the top portion of the closure.

* * * * *